United States Patent [19]

Glaser

[11] 4,024,429

[45] May 17, 1977

[54] OPERATING VOLTAGE SUPPLY SYSTEM FOR GAS DISCHARGE DISPLAY PANEL

[75] Inventor: David Glaser, Warren, N.J.

[73] Assignee: Panel Technology, Inc., Lewistown, Pa.

[22] Filed: Oct. 6, 1975

[21] Appl. No.: 619,990

[52] U.S. Cl. ..... 315/169 TV; 315/166; 315/169 R

[51] Int. Cl.[2] ..... H05B 41/14

[58] Field of Search ..... 315/169 TV, 166, 167, 315/168, 164, 160, 169 R

[56] References Cited

UNITED STATES PATENTS

| | | | |
|---|---|---|---|
| 2,700,146 | 1/1955 | Bachelet | 315/163 |
| 3,821,596 | 6/1974 | Leuck | 315/169 TV |
| 3,842,314 | 10/1974 | Iwaawa | 315/169 TV |
| 3,848,086 | 11/1974 | Ikeda | 315/169 TV |
| 3,891,983 | 6/1975 | Lee | 315/169 R |

FOREIGN PATENTS OR APPLICATIONS

| | | | |
|---|---|---|---|
| 2,200,637 | 8/1972 | Germany | 315/169 R |

*Primary Examiner*—Eugene R. La Roche
*Attorney, Agent, or Firm*—Jim Zegeer

[57] ABSTRACT

There is disclosed a voltage supply system for a gas discharge display panel where the operating signal voltages for such panels is derived from a low amplitude signal voltage source which source must be protected from high voltage transients. In accordance with the invention, a voltage stabilization circuit in the voltage system incorporates means for integrating the leading edge of the applied D.C. power supply voltage to prevent damage to the operating components of the low amplitude signal voltage source system.

3 Claims, 1 Drawing Figure

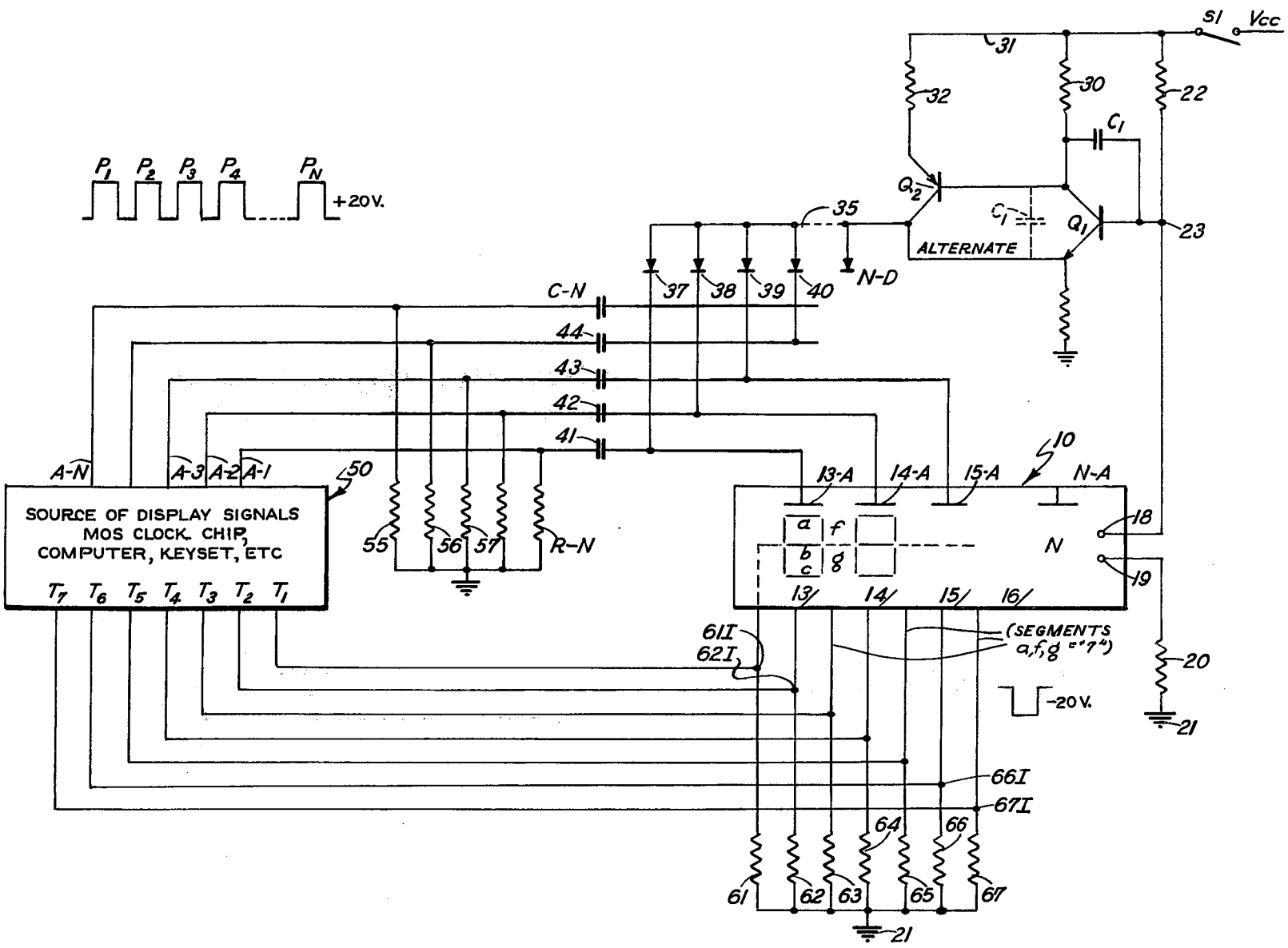
Vcc
S1
22
23
20
21
C1
30
31
32
Q1
Q2
ALTERNATE
N-D
35
40
39
38
37
10
N-A
N
18
19
15-A
14-A
13-A
16
15
14
13
a
b
c
d
e
f
g
(SEGMENTS a,f,g = "7")
-20 V.
66I
67I
61
62
63
64
65
66
67
61I
62I
C-N
44
43
42
41
R-N
57
56
55
50
SOURCE OF DISPLAY SIGNALS
MOS CLOCK, CHIP,
COMPUTER, KEYSET, ETC
A-1
A-2
A-3
A-N
T1
T2
T3
T4
T5
T6
T7
P1
P2
P3
P4
PN
+20V.

OPERATING VOLTAGE SUPPLY SYSTEM FOR GAS DISCHARGE DISPLAY PANEL

BACKGROUND OF THE INVENTION

A number of gas discharge display panels in the prior art are generally characterized as being segmented electrode display systems and these typically incorporate a plurality of groups of cathode segments, each group being arranged in a character display position, typically in a figure "8" configuration, and a dielectric layer having openings therein at the segments for masking the interconnecting printed circuitry from the gaseous medium. An anode electrode, typically a transparent tin oxide coating on a cover plate or perforated element grid is provided, there being one anode for each group of characters. In addition, there is typically provided a keep alive discharge which provides a supply of free electrons and ions for priming and conditioning of the panel so as to avoid or minimize statistical ionization time delays inherent in gas discharge displays from the application of the voltage to a particular anode-cathode grouping to the onset of the discharge.

Known voltage supply systems include voltage stabilization means for relating the voltage applied to the anode-cathode electrodes directly to some function or condition taking place inside the panel so that the circuitry self adapts voltage supplied to the anode-cathode electrodes to various tolerances encountered in the manufacturing of such display panels and to changes occurring after a period of use.

In one prior art system invented by the inventor hereof a single high voltage transistor had its base electrode connected to a reference electrode. Such high voltage transistors normally have low current gain and on heavy current loads, such as when the number 8 is being displayed, the system begins to draw current from the reference electrode and the reference then goes out. This defect is avoided in accordance with the present invention by providing a PNP-NPN transistor couple to achieve a very high gain voltage follower with very small loss and isolates or provides a block of variation in loading from affecting the reference. This permits the flow of the minimum current to the reference electrode and still sustain a very high signal current to the load, the anodes in the display. The emitter of the NPN transistor and the collector of the PNP are commonly connected to a large resistor and the anode-cathodes of the display, constituting the load, are connected to this point, each anode being isolated by a blocking diode. The transistor couple functions as a voltage follower with high current gain and the isolation of the source of control voltage from the load is effective over a wide range of load current.

In a typical arrangement, the keep alive electrodes of a gas discharge display panel have applied thereto a fixed direct current voltage which initiates a discharge at the keep alive anode-cathode electrode pair and, in conjunction with a resistor between one of the electrodes and the electrode pair, provides a measuring circuit for measuring one or more conditions existent in the tube. This measured voltage then is applied to a control circuit which includes data sources such as MOS chip circuits. Normally the voltage comes up slowly because it is from a filtered supply. However, in some cases, the power supply is arranged so that when the direct voltage is applied to the keep alive electrodes the turn on switch is not on the alternating current side of the supply but rather is on the direct current side of the high voltage supply so that there is always a high voltage which is applied through a switch to the circuit. This establishes a sharp step function which is coupled directly to the MOS chip and in the case of a capacitor drive circuit, there is a rate of rise of voltage due to the charging current for the capacitor which develops enough voltage to possibly destroy the MOS chip.

In accordance with a further feature of the present invention, the rate of rise of this voltage is controlled by providing a coupled pair of voltage gain transistors with a capacitor connected between the collector and emitter of the input transistor so that the rate of rise of the voltage at the output of the voltage follower is a ramp voltage. Thus, the control can be stepped to any rate desired and if the rate of rise of voltage is controlled, then the maximum voltage drop in the system is easily determinable and hence controlled.

BRIEF DESCRIPTION OF THE DRAWING

The drawing is a schematic representation of a portion of a gas discharge display panel and a supply system incorporating the invention.

DETAILED DESCRIPTION OF THE PREFERRED EMBODIMENTS

Referring now to the drawing, the gas panel 10 is of a type well known in the art having a base support plate carrying a plurality of character display positions 13, 14, 15 and N, each character position having a group of cathode elements *a*, *b*, *c*, *d*, *e*, *f* and *g* and a separate anode electrode 13A, 14A, 15A and NA. Other display positions may be provided for displaying colons, decimal points, letters and symbols. The panel 10 preferably has silver or other precious metal electrodes serving as cathode electrodes and transparent tin oxide anode electrodes. In addition, the panel 10 incorporates a pair of keep alive electrodes, keep alive anode 18 and keep alive cathode 19, the keep alive cathode 19 being connected through a range resistor 20 to a point of common potential 21 or ground. Hereafter, the keep alive electrode pair 18 and 19 will simply be referred to as the keep alive and functions as the normal conditioning, priming means, etc. for such panels.

THE ANODE SUPPLY

The keep alive is connected in a series circuit with a 680 ohm resistor 22 which, jointly, constitute a voltage divider with the intermediate point 23 of this voltage divider being connected to the base electrode of transistor Q1. In this arrangement then the current flowing through the resistor 22 corresponds to the current flowing through the keep alive and hence the voltage at the intermediate point 23 is directly proportional to operating conditions in the panel 10. In this case, it can be the gas, a variation in the pressure consistency, or spacing at the keep alive. This then is also a measure of the discharge conditions in the character display positions 13, 14, 15 and N as between the cathode electrodes at these positions and the anode electrodes thereof. The collector of transistor Q1 is connected to the base of transistor Q2 and the collector of transistor Q2 and the emitter of Q1 are connected through a large resistor 25 (1 megohm, for example) to ground to constitute a high gain voltage follower. The collector of transistor Q1 is collected through a small resistor 30 to the supply line 31 and the emitter of transistor Q2 is connected through a similar resistor 32 to the supply line. It will be noted that a switch S1 is connected between the supply line 31 and the 220 volt supply $V_{cc}$. Thus, whenever the switch S1 is closed, the full 220 voltage supply initially appears at intermediate point 23 in a step voltage function until discharge occurs at the keep alive. This voltage assures that a conventional discharge occurs between keep alive anode 18 and keep alive cathode 19 so that the keep alive can be maintained on. Transistor Q1 is an NPN transistor and transistor Q2 is a PNP transistor which together constitute a PNP/NPN couple so as to be a beta multiplier with very small loss and thereby provide a very high gain voltage follower which can maintain a very low reference current and sustain a very high signal or anode current without interfering with the voltage at the intermediate point 23.

The voltage applied at intermediate point 23 is applied through the PNP/NPN couple Q1, Q2 which act as a voltage follower. The output voltage of this system is about six tenths of a volt less than the input voltage over a very wide range so that whatever the voltage is at intermediate point 23 is the voltage which is applied to an output line 35. The voltage at output line 35 is designated as the anode stabilization supply line. Anode stabilization voltage supply line 30 is coupled through blocking diodes 36, 37, 38, 39 and ND to the individual anodes 13A, 14A, 15A, and NA and, at the same time, to one side of coupling capacitors 41, 42, 43, 44, and C-N, respectively. As used herein above, "N" designates the "Nth circuit", there being for example, an anode-cathode group-diode-capacitor etc. for the Nth display position and any intervening display position. Thus, a voltage slightly below the voltage at the intermediate point 23 is applied via diodes 37-ND to the anodes 13A-NA. This voltage is below the voltage level necessary to initiate a discharge at any of the character positions and is blocked from the source of information or display signal 50 by the capacitors 42-CN, which during quiescent times are charged to the anode stabilization voltage level through resistors 55, 56, 57, . . . RN.

Each of the cathodes *a, b, c, d, e, f,* and *g* are commonly connected together, character positioned for character position so that the voltage applied to a cathode for character position 13 is the same voltage which is applied to the cathode for character position 16. Thus, the common connection of each of the individual cathode elements positioned for position reduces the number of external supply terminals to the panel for supplying operating voltages. Thus, all of the segments are extended via a conductor (shown in dotted line for the *b* segments) to the edge of the panel 10. These common conductors then are connected through a ground resistor 61, 62, 63, 64, 65, 66 and 67 (in the exemplary panel 10 embodiment, the conventional seven segment cathode in the figure 8 configuration is disclosed). The intermediate points 61-I through 67-I of the connection between these resistors and their respective cathode segments is connected to an output terminal of a source of data signals such as a data source 50. These output terminals are designated at T1, T2, T3, T4, T5, T6 and T7, there being seven terminals, one corresponding to each of the individual cathode segments illustrated. The source of display signals 50 supplies a timed sequence of positive pulses each about 20 volts in amplitude, at anode output terminals A-1, A-2 . . . AN. Permutations of signals in any one time sequence on the output terminals T1–T7 causes, at each of these time intervals, the information to be displayed at a particular character position which is being energized in that time position. In the drawing, the waveform diagrams labeled P1, P2, P3, P4, PN are the pulse waveforms appearing in the time sequence on the conductors P1, P2, P3, P4 and PN leading from the data source 50. Thus, the voltage P1 appearing on terminal A-1 is applied through coupling capacitor 41 to the anode electrode.This voltage P1 adds to the anode stabilization voltage as stored upon capacitor 1. This voltage then constitutes the anode voltage on anode 13A at that instant of time. In the event there are any signal voltage permutations on any of the terminals T1–T7, at the interval of time that this sum of voltages is on anode electrode 13A, then the cathode segments having such permutated pattern of voltages will glow with the cathode glow thereby discharging, at least partially, the capacitor 36. If the permutated pattern of potentials on terminals T1–T7 remains the same and then the positive pulse P2 on terminal A2 is applied to capacitor 42 (the voltage on A1 having been removed so that the first character position 13A extinguishes) anode 14A is then energized so that the same character will be displayed in character position 14 by the glowing cathode elements or segments. This proceeds throughout the character positions 13, 14, 15 and N. In the particular instance shown, the data source 50 is a clock chip for producing timing signals as may be used in a microwave range or oven and the display alement displays the time, for example, cooking time. Thus, the character positions 13 and 14 can be minutes and the character positions 15 and N can be seconds, with a colon therebetween.

A capacitor C1 is connected between the collector and base electrode of NPN transistor Q1. This capacitor converts the NPN/PNP-transistor circuit to a form of a Miller integrator so that any large step voltage appearing at intermediate point 23 is converted to a ramp voltage and prevents any voltage on the anode stabilization voltage supply line 35 from exhibiting any sharp step voltage rise. It should be noted that there is a slight statistical delay before the keep alive discharge between keep alive electrodes 18 and 19 is initiated so that the voltage at 23 is the full supply voltage (220 volts) which, in the absence of capacitor C1, is conveyed through the voltage follower NPN-PNP couple to the anode stabilization voltage supply line 35. Moreover, the use of the NPN-PNP transistor couple as a voltage follower for a voltage stabilization supply scheme as is illustrated in the drawing, provides high current gain and yet provides good isolation of the intermediate point 23 from the anode stabilization voltage supply line 35 and hence from the MOS circuit in data source 50.

Thus, there has been disclosed a gas discharge display panel system having a plurality of electrode groupings, there being one at character positions 13, 14, 15, 16 and N, each of the electrode groupings including cathode electrode segments and an anode electrode. The MOS circuit in source of data 50 supplies the low voltage negative potential to permutated ones of the cathode segments *a, b, c, d, e, f,* and *g* and a positive potential to each of the anode electrodes 13A, 14A, 15A and NA in a cyclical or repetitive fashion and one at a time in a sequence via capacitors 36–40, respectively. These capacitors also store the stabilized voltage for summing with the cyclically supplied positive potential for the anode so that the simultaneous occurrence of the stabilized voltages at each electrode grouping for each character position serves to energize the permutated pattern of cathodes to provide the cathode glow and hence the display of the information conveyed by the permutated patterns of the cathode segments.

As state above, the capacitor C1 connected between the collector and base electrodes of transistor Q1 converts the NPN transistor to a form of Miller integrator to thereby assure that any sharp step voltages appearing at intermediate point 23 of the voltage divider constituted by resistor 22 and the keep alive is converted to a ramp function so that no sharp voltage rises are conveyed through the blocking diodes 31–35 and coupling capacitors 36–40 to the MOS circuit.

While the preferred embodiment of the invention has been disclosed herein, it is believed that a number of variations and modifications are possible and obvious to those skilled in the art, and such obvious variations and modifications are intended to be encompassed within the claims appended hereto.

What is claimed is:

1. In a gas discharge display panel system having a plurality of electrode groupings constituting a corresponding number of character display positions, each electrode grouping including a plurality of cathode electrode segments and an anode electrode, MOS circuit means for supplying a low voltage negative potential to permutated ones of said cathode segments and cyclically supplying a positive potential to the anode of each electrode grouping one at a time and in a sequence, a source of stabilized voltage, and capacitor storage means connected between said MOS circuit and said source of stabilized voltage for storing said stabilized voltage for summing with said cyclically supplied positive potential, the simultaneous occurrence of said stabilized voltage and said positive and negative voltage pulses at any electrode grouping producing a visual display of the information in permutated ones of said cathode segments, the improvement comprising said source of stabilized voltage includes a D.C. source of direct current voltage having a magnitude less than the voltage needed to achieve a breakdown in the discharge gas medium in said panel, a voltage divider connected across said direct current voltage source, said voltage divider having serially connected resistance and a keep alive discharge gap in said panel, with an intermediate point at said keep alive for developing a voltage proportional to a condition in said panel, a NPN-PNP transistor couple connected as a voltage follower having the input thereof connected to said intermediate point for tracking changes in said source of stabilization voltage and providing a high current gain and isolating said electrode grouping from said source of stabilized voltage.

2. The invention defined in claim 1, including a capacitor connected between the collector and base electrodes of the NPN transistor of said transistor couple for preventing a large step voltage rise in the output voltage from said transistor couple.

3. The invention defined in claim 1 wherein said NPN-PNP couple includes a high impedance commonly connected to the emitter of said NPN, the collector of said PNP and to each of the anodes of said groups.

* * * * *